US006517405B1

(12) United States Patent
Cheng et al.

(10) Patent No.: US 6,517,405 B1
(45) Date of Patent: Feb. 11, 2003

(54) PROCESS FOR FORMING A FILM ON A SUBSTRATE HAVING A FIELD EMITTER

(75) Inventors: Huang-Chung Cheng, Hsinchu (TW); Fu Gow Tarntair, Taipei (TW); Wei Kai Hong, Yung-Ho (TW)

(73) Assignee: National Science Council, Taipei (TW)

( * ) Notice: Subject to any disclaimer, the term of this patent is extended or adjusted under 35 U.S.C. 154(b) by 0 days.

(21) Appl. No.: 09/482,504

(22) Filed: Jan. 13, 2000

(30) Foreign Application Priority Data

Nov. 10, 1999 (TW) ..... 88119635 A

(51) Int. Cl.[7] ..... H01J 9/02

(52) U.S. Cl. ..... 445/50; 445/24; 427/77

(58) Field of Search ..... 313/311; 445/24, 445/50; 427/77

(56) References Cited

U.S. PATENT DOCUMENTS

| | | | | | |
|---|---|---|---|---|---|
| 4,958,590 | A | * | 9/1990 | Goforth | 118/723 |
| 5,580,380 | A | * | 12/1996 | Liu et al. | 117/129 |
| 5,602,439 | A | * | 2/1997 | Valone | 313/309 |
| 5,702,281 | A | * | 12/1997 | Huang et al. | 445/50 |
| 5,944,573 | A | * | 8/1999 | Mearini et al. | 445/50 |
| 6,132,278 | A | * | 10/2000 | Kang et al. | 445/50 |

* cited by examiner

*Primary Examiner*—Kenneth J. Ramsey
(74) *Attorney, Agent, or Firm*—Christensen O'Connor Johnson Kindness PLLC

(57) ABSTRACT

A process for forming a film on a substrate having a field emitter is disclosed. The substrate and field emitter are cleaned by hydrogen plasma to remove the impurities. Next, a silicon carbide film is selectively formed over said field emitter. A negative bias voltage of about 150 V to about 300 V is applied to substrate for increasing the nucleation sites of said silicon carbide film. Afterward, the negative bias voltage is stopped so as to grow a carbon-containing film from said silicon carbide film.

2 Claims, 6 Drawing Sheets

PROCESS FOR FORMING A FILM ON A SUBSTRATE HAVING A FIELD EMITTER

FIELD OF THE INVENTION

The present invention relates to a process for forming a film on a substrate having a field emitter by bias enhanced nucleation chemical vapor deposition.

DESCRIPTION OF THE RELATED ART

FIGS. 1A through 1C illustrate a process flow for forming a diamond film on a silicon field emitter, which has characteristics of low work function, high chemical/physical stability, and high hardness. The diamond film is utilized for improving the performance of a silicon field emission device.

FIG. 1A shows a silicon substrate 10 having a silicon tip as a field emitter 12.

As shown in FIGS. 1B through 1C, a diamond thin film 20 is grown by microwave plasma chemical vapor deposition (MPCVD), electron cyclone resonance chemical vapor deposition (ECR-CVD), or laser ablation. Subsequently, a final diamond layer 30 depicted in FIG. 1C is formed.

However, it is difficult to etch a diamond layer with conventional semiconductor technology due to its high hardness and high chemical/physical stability. Therefore, conventional diamond layer formation methods cannot be used in field emission devices that contain conductive gate. electrodes.

SUMMARY OF THE INVENTION

In view of the above disadvantages, an object of the invention is to provide a process for forming a film on a substrate having a field emitter. Thus, a carbon-containing film such as diamond film can be selectively deposited on a silicon tip.

Another object of the invention is to maintain a high aseptic ratio of the diamond film.

Also, further another object of the invention is to form a field emitter having multiple-tips so as to improve performance of the field emission device.

The above objects are attained by providing a process for forming a film on a substrate having a (silicon) field emitter, said process comprising the steps of: (a) cleaning said substrate and said field emitter by hydrogen plasma to remove the impurities thereon; (b) forming a silicon carbide film over said field emitter; (c) applying a negative bias voltage of about 150 V to about 300 V to said substrate for increasing the nucleation sites of said silicon carbide film; and (d) stopping said negative bias voltage so as to grow a carbon-containing film from said silicon carbide film.

In an embodiment of said invention, the silicon carbide film in step (b) is formed by electron cyclone resonance chemical vapor deposition (ECR-CVD) using a mixture gas containing silicane and methane, wherein the process is performed at room temperature and with a microwave power of about 1000W.

The step (b) of the process of this invention can further comprise the step of applying a negative bias voltage of about 100 V to about 300 V to said substrate.

The carbon-containing film formed by the process of this invention can be a diamond film, diamond-like film, amorphous carbon film, or graphite-like film.

BRIEF DESCRIPTION OF THE DRAWINGS

The preferred embodiment of the invention is hereinafter described with reference to the accompanying drawings in which:

FIGS. 1A through 1E are cross-sectional side views showing the conventional manufacturing steps of forming a diamond film on silicon field emitter;

DESCRIPTION OF THE PREFERRED EMBODIMENTS

First Embodiment

Figure 1A:
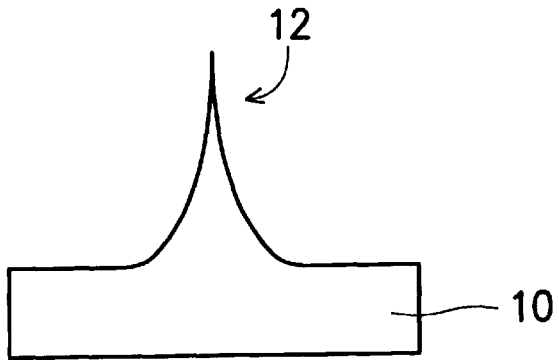
FIG. 1A (PRIOR ART)
Figure 1B:
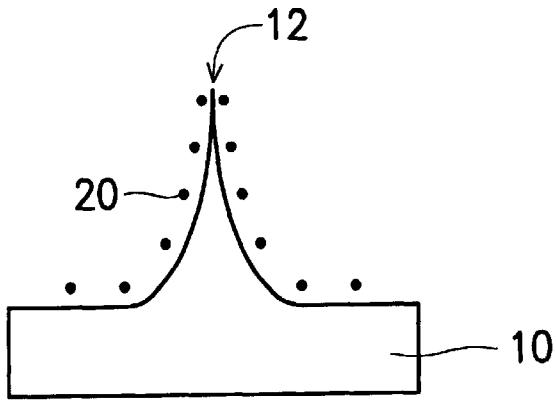
FIG. 1B (PRIOR ART)
Figure 1C:
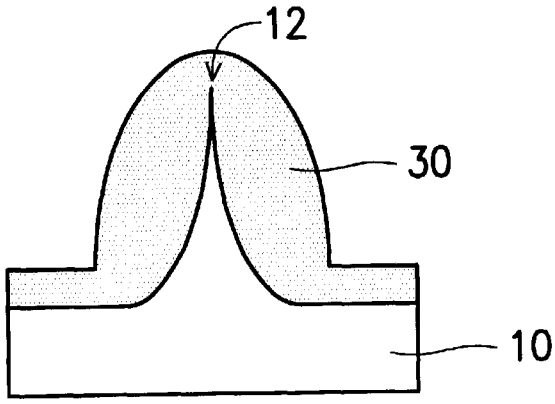
FIG. 1C (PRIOR ART)
Figure 2A:
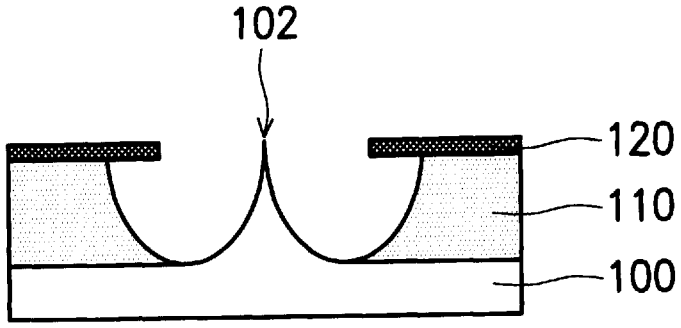
FIGS. 2A through 2C are cross-sectional side views showing the manufacturing steps of forming a diamond film on a silicon field emitter according to a first embodiment of the present invention.
Figure 2B:
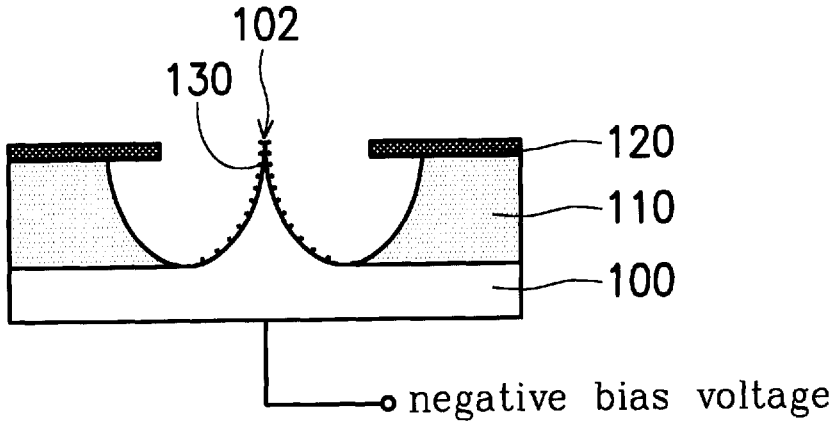
Figure 2C:
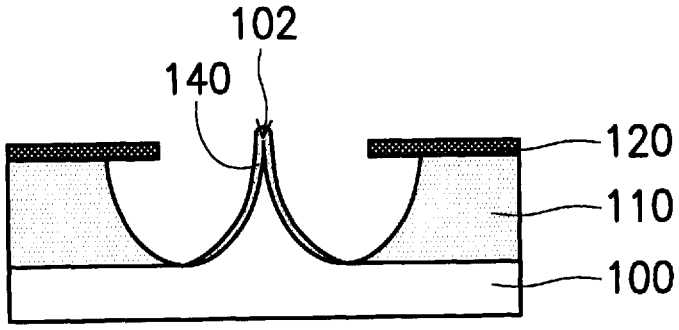

FIGS. 2A through 2C illustrate a process flow for forming a diamond film on a field emitter.

FIG. 2A illustrates a silicon substrate 100 having a tip as a field emitter 102. An insulating layer 110 such as silicon oxide is formed on the silicon substrate 100. A conductive layer 120 serving as a gate is formed over the insulating layer 110. The substrate 100 described above is placed in a microwave CVD chamber (vacuum environment). To keep the pressure of the chamber at about 20 torr, hydrogen gas is supplied. Next, the hydrogen plasma is produced at a microwave power of about 1000 W for about 10 minutes for cleaning the surfaces of the substrate 100 and the field emitter 102, thereby eliminating impurities such as contaminants and oxide.

Afterward, the silicon substrate 100 is heated to achieve a temperature of about 800° C. A silicon carbide film (not numbered) is formed in a mixture gas containing hydrogen and methane (0.7 to 5.0 percent by volume of methane) at a microwave power of about 450 W to 1000 W. Also, a negative bias voltage of about 100 V to 300 V is preferably applied to the silicon substrate 100 while the silicon carbide film described above is being formed. Then, a negative bias voltage of about 150 V to 300 V is applied to the silicon substrate 100 to increase nucleation sites of the silicon carbide into a nucleation layer 130 as illustrated in FIG. 2B. Alternately, the methane described above can be replaced with a mixture gas of methane and carbon dioxide having a mixing ratio of 18/30~40/30.

Next, the silicon substrate 100 is heated to achieve a temperature of about 800° C. to 1200° C. while the microwave power is adjusted to about 2000 W. Then, the carbon-containing film 140 such as a diamond film is epitaxially grown from the nucleation film 130 after stopping the negative bias voltage.

It is understood that the silicon carbide film of the embodiment can also be formed by electron cyclone resonance chemical vapor deposition (ECR-CVD) using a mixture gas containing silicane and methane, at room temperature and at a microwave power of about 1000 W.

Second Embodiment

Figure 3A:
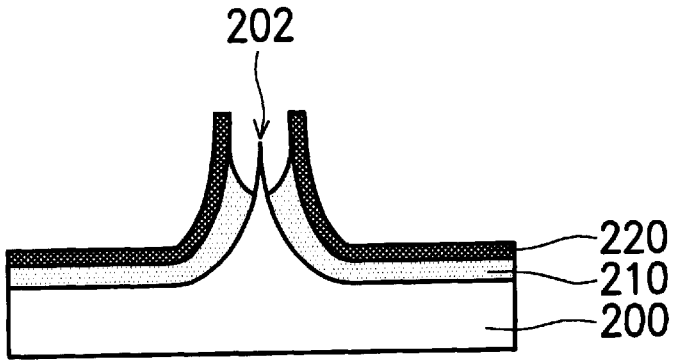
FIGS. 3A through 3C are cross-sectional side views showing the manufacturing steps of forming a diamond film on a silicon field emitter according to a second embodiment of the present invention.
Figure 3B:
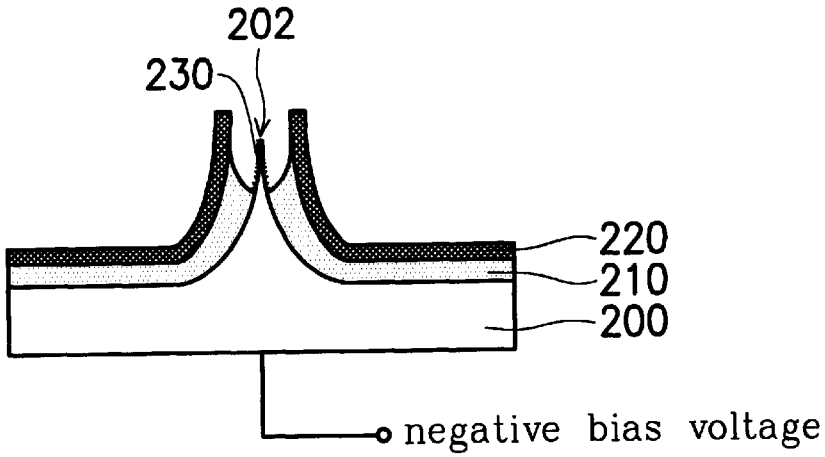
Figure 3C:
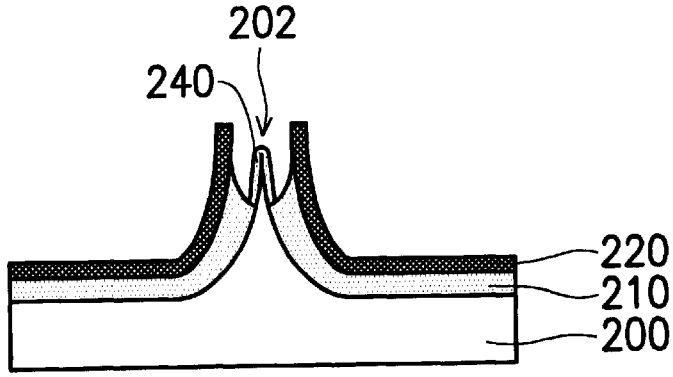

FIGS. 3A through 3C illustrate another process flow for forming a diamond film on a field emitter.

As shown in FIG. 3A, a reference number 200 denotes a silicon substrate. The shapes of the insulating layer 210 and conductive layer 220 are different from those of the first embodiment. A nucleation film 230 (referring to FIG. 3B) and carbon-containing film 240 such as a diamond film (referring to FIG. 3C) are sequentially formed on a field emitter 202 in the same manner as in first embodiment.

Third Embodiment

Figure 4A:
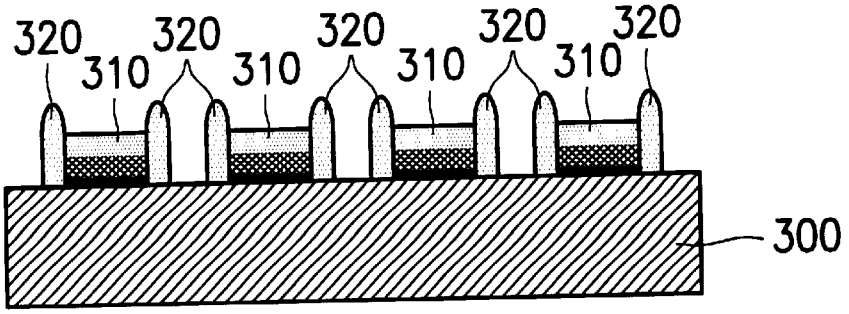
FIGS. 4A through 4C are cross-sectional side views showing the manufacturing steps of forming a diamond film on a silicon field emitter according to a third embodiment of the present invention.
Figure 4B:
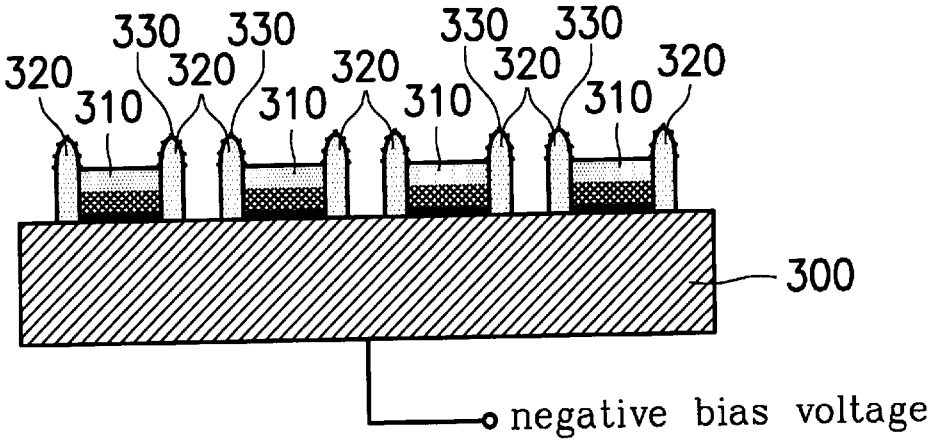
Figure 4C:
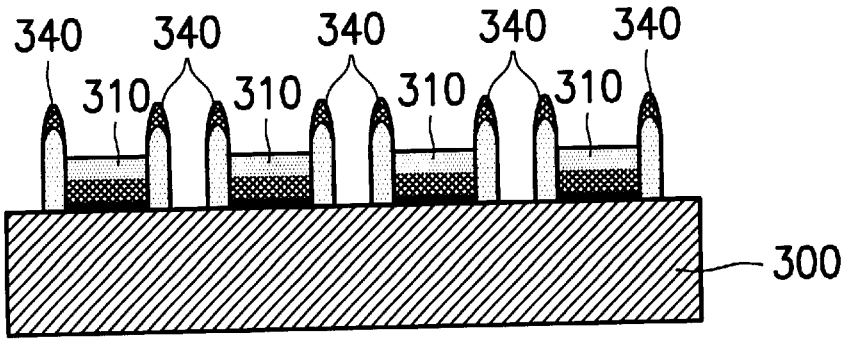

FIGS. 4A through 4C illustrate another process flow for forming a diamond film on a diode field emitter.

As illustrated in FIG. 4A, ring-shaped field emitter 320 is formed on the sidewalls of an insulating layer 310 and on the silicon substrate 300. A nucleation firm 330 (referring to FIG. 4B) and carbon-containing film 340 such as a diamond film (referring to FIG. 4C) are sequentially formed on a field emitter 302 in the same manner as in first embodiment.

Fourth Embodiment

FIGS. 5A through 5D illustrate another process flow for forming a diamond film on a field emitter.

Figure 5A:
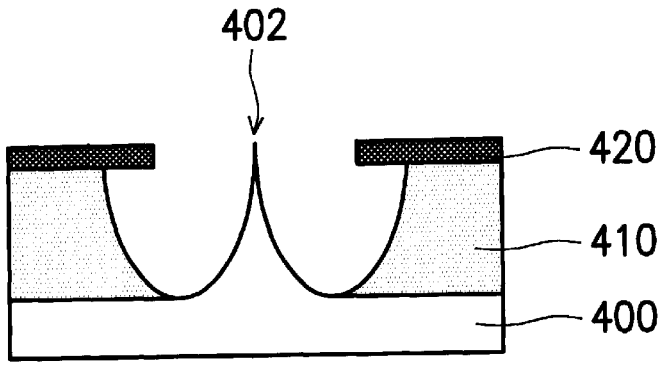
FIGS. 5A through 5D are cross-sectional side views showing the manufacturing steps of forming a diamond film on a silicon field emitter according to a fourth embodiment of the present invention.

FIG. 5A illustrates a silicon substrate 400 having a tip as a field emitter 402. An insulating layer 410 such as silicon oxide is formed on the silicon'substrate 400. A conductive layer 420 serving as a gate is formed over the insulating layer 410. The substrate 400 described above is placed in a microwave CVD chamber (vacuum environment). To keep the pressure of the chamber at about 20 torr, hydrogen gas is supplied. Next, the hydrogen plasma is produced at a microwave power of about 1000 W for about 10 minutes for cleaning the surfaces of the substrate 400 and the field emitter 402, thereby eliminating impurities such as contaminants and oxide.

Figure 5B:
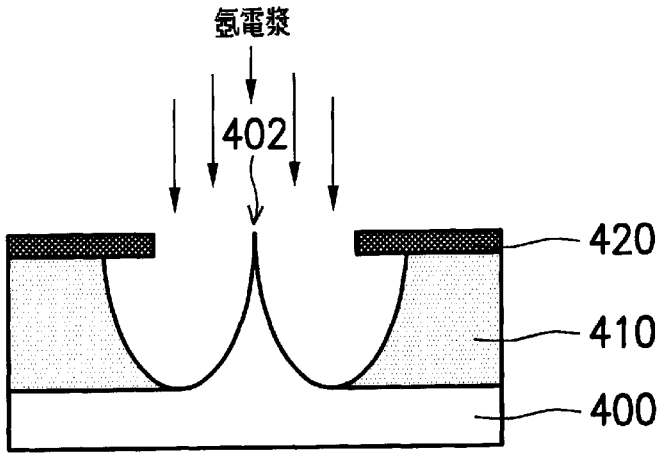
Figure 5C:
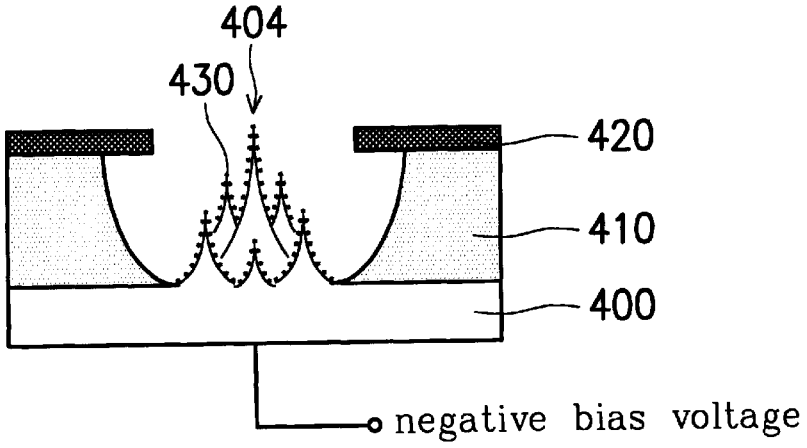

Afterward, as shown as FIG. 5B, the silicon substrate 400 is heated to achieve a temperature of about 800° C. A silicon carbide film (not numbered) is informed in a mixture gas containing hydrogen and methane (methane/hydrogen=10/30~20/30) at a microwave power of about 450 W to 1000 W. Next, the field emitter 402 is sputtered by argon plasma in order to form a field emitter 404 including multiple tips. Then, a negative bias voltage of about 150 V to 300 V is applied to the silicon substrate 400 to increase nucleation sites of the silicon carbide into a nucleation layer 430 as illustrated in FIG. 5C.

Figure 5D:
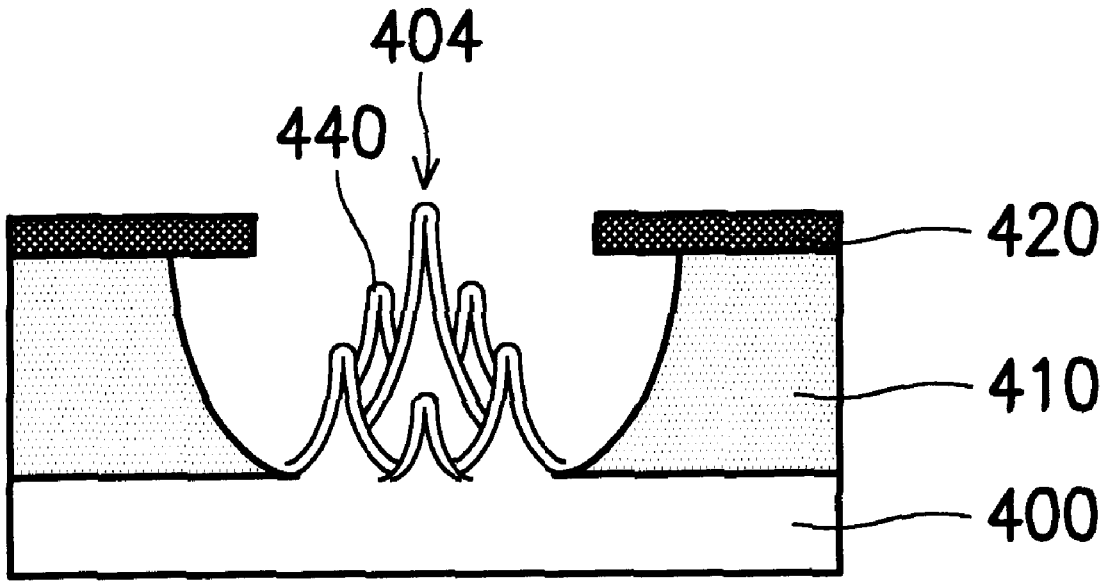

Next, as shown in FIG. 5D, the silicon substrate 400 is heated to achieve a temperature of about 800° C. to 1200° C. while the microwave power is adjusted to about 2000 W. Then, the carbon-containing film 440 such as a diamond film is epitaxially grown from the nucleation film 430 after stopping the negative bias voltage.

The carbon-containing film such as diamond film can be selectively deposited at a high aspect ratio. Also, a field emitter having multiple-tips can be easily fabricated by means of the process of the invention. Furthermore, it is not required to etch the diamond layer in the process of the invention.

While the invention has been described with reference to various illustrative embodiments, the description is not intended to be construed in a limiting sense. Various modifications of the illustrative embodiments, as well as other embodiments of the invention, will be apparent to those person skilled in the art upon reference to this description. It is therefore contemplated that the appended claims will cover any such modifications or embodiments as may fall within the scope of the invention defined by the following claims and their equivalents.

What is claimed is:

1. A process for forming a film on a substrate having a field emitter, said process comprising:

(a) cleaning said substrate and said field emitter by hydrogen plasma to remove the impurities thereon;

(b) forming a silicon carbide film over said field emitter by electron cyclone resonance chemical vapor deposition (ECR-CVD) using a gas mixture containing silicane and methane, at room temperature and a microwave power of about 1000 W;

(c) applying a negative bias voltage of about 150 V to about 300 V to said substrate for increasing the nucleation sites of said silicon carbide film; and (d) stopping said negative bias voltage so as to grow a carbon-containing film from said silicon carbide film.

2. A process for forming a film on a substrate having a field emitter, said process comprising:

(a) cleaning said substrate and said field emitter by hydrogen plasma to remove the impurities thereon;

(b) forming a silicon carbide film over said field emitter;

(c) applying argon plasma to treat said field emitter so as to form a multiple-tip field emitter;

(d) applying a negative bias voltage of about 150 V to about 300 V to said substrate for increasing the nucleation sites of said silicon carbide film; and (e) stopping said negative bias voltage so as to grow a carbon-containing film from said silicon carbide film.

* * * * *